US012503270B2

(12) United States Patent
Mack

(10) Patent No.: US 12,503,270 B2
(45) Date of Patent: Dec. 23, 2025

(54) HINGED-LID BOX

(71) Applicant: GPI Frankfurt & Augsburg GmbH, Kriftel (DE)

(72) Inventor: Ralf Mack, Munich (DE)

(73) Assignee: Graphic Packaging International, LLC, Atlanta, GA (US)

( * ) Notice: Subject to any disclaimer, the term of this patent is extended or adjusted under 35 U.S.C. 154(b) by 129 days.

(21) Appl. No.: 18/038,856

(22) PCT Filed: Nov. 26, 2021

(86) PCT No.: PCT/EP2021/083159
§ 371 (c)(1),
(2) Date: May 25, 2023

(87) PCT Pub. No.: WO2022/112499
PCT Pub. Date: Jun. 2, 2022

(65) Prior Publication Data

US 2024/0017873 A1 Jan. 18, 2024

(30) Foreign Application Priority Data

Nov. 27, 2020 (DE) ..... 20 2020 106 839.3

(51) Int. Cl.
*B65D 5/20* (2006.01)
*B65D 5/24* (2006.01)
*B65D 5/66* (2006.01)

(52) U.S. Cl.
CPC ..... *B65D 5/2052* (2013.01); *B65D 5/2019* (2013.01); *B65D 5/2033* (2013.01);
(Continued)

(58) Field of Classification Search
CPC .. B65D 5/2052; B65D 5/2019; B65D 5/2033; B65D 5/2038; B65D 5/244;
(Continued)

(56) References Cited

U.S. PATENT DOCUMENTS 3,627,541 A 12/1971 Farquhar
5,217,159 A * 6/1993 Calvert ..... B29C 66/4326 229/5.84

(Continued)

FOREIGN PATENT DOCUMENTS

GB 2 296 364 A 6/1996
JP 2002-104381 A 4/2002

(Continued)

OTHER PUBLICATIONS

International Search Report and Written Opinion for PCT/EP2021/083159 dated Feb. 24, 2022.

(Continued)

*Primary Examiner* — Christopher R Demeree
(74) *Attorney, Agent, or Firm* — Andrew N. Claerbout; FisherBroyles, LLC

(57) ABSTRACT

A folding box having a lower part and a hinged lid positionable relative to the lower part to a closed position of the folding box. The lower part having a bottom wall, a plurality of side walls, and a plurality of dust flaps. At least one of the plurality of side walls has an upper edge comprising a free edge and is arranged between two adjacent side walls having an upper edge foldably connected to a dust flap. The hinged lid has a top wall foldably connected to one of the plurality of side walls and at least one insertion tab. The at least one insertion tab is for insertion into a gap between that at least one of the plurality of side walls with the free edge and the dust flaps of the two adjacent side walls when the hinged lid is in the closed position.

24 Claims, 8 Drawing Sheets

(52) U.S. Cl.
CPC ..... *B65D 5/2038* (2013.01); *B65D 5/244* (2013.01); *B65D 5/6626* (2013.01)

(58) Field of Classification Search
CPC .... B65D 5/6626; B65D 5/2047; B65D 5/665; B65D 5/6661; B65D 5/2057; B65D 5/241; B65D 5/563; B65D 5/4266; B65D 5/6655; B65D 5/2061; B65D 5/4204; B65D 85/36; B65D 5/24; B65D 5/3657; B65D 5/4279; B65D 5/64; B65D 5/62
USPC ..... 229/106, 110, 186, 114, 155, 128, 150, 229/162.1, 5.84, 125.27, 125.28, 126, 229/190, 194, 902; 428/34.2
See application file for complete search history.

(56) References Cited

U.S. PATENT DOCUMENTS 5,411,204 A * 5/1995 DeMay ..... B65D 5/244 229/114
5,415,340 A * 5/1995 Calvert ..... B65D 5/563 229/5.84
5,855,315 A * 1/1999 Roseth ..... B65D 5/5495 229/120.04
9,505,516 B2 * 11/2016 Hubbard, Jr. ..... B65D 5/2057
11,465,798 B2 * 10/2022 Epstein ..... H04W 76/19
11,794,945 B2 * 10/2023 Valencia ..... B31B 50/26
11,932,463 B2 * 3/2024 Epstein ..... B65D 5/4266
11,993,428 B2 * 5/2024 Mayer ..... B31B 50/004

FOREIGN PATENT DOCUMENTS

JP 2005-329988 A 12/2005
WO WO 96/38342 A1 12/1996

OTHER PUBLICATIONS

Translation of International Search Report for PCT/EP2021/083159 dated Feb. 24, 2022.

* cited by examiner

HINGED-LID BOX

The present application is a national stage entry under 35 U.S.C. § 371 of International Patent Application No. PCT/EP2021/083159, filed on Nov. 26, 2021, which claims the benefit of German Patent Application No. 20 2020 106 839.3, filed on Nov. 27, 2020.

The disclosures of each of International Patent Application No. PCT/EP2021/083159, filed on Nov. 26, 2021, and German Patent Application No. 20 2020 106 839.3, filed on Nov. 27, 2020, are hereby incorporated by reference for all purposes as if presented herein in their entirety.

The invention relates to a hinged-lid box for transporting salad, vegetables, mushrooms, potatoes, rice, noodles or other side dishes.

Disposable containers for salads, vegetables, mushrooms, potatoes, rice, noodles or other side dishes are required for delivery services, take-away sales by restaurants and in fast-food system gastronomy. The use of shells made of plastic materials (such as PE, PP, PET, PS), which must be disposed of in the residual waste after use, is known. Also known are compostable disposable shells or cups for salad or delicatessen made from polyactides (PLA). PLA containers are relatively expensive. In addition, salad shells or cups made of cardboard are known, which are formed similar to ice cream cups with a peripheral side wall, a glued bottom wall and a beaded edge. These are relatively expensive to manufacture. Furthermore, so-called clamshell boxes (also called "burger boxes") are used for salads, which boxes have two shell parts hinged together about a fold line and lockable to each other at the front edge. Clamshell boxes are also relatively expensive to manufacture. In addition, the filling of the boxes with small-sized product is limited due to the division into two halves.

On this basis, the object of the invention is to create a container for salad, vegetables, mushrooms, potatoes, rice, noodles or other side dishes that is easy to fill and close, can be manufactured in large quantities with little effort and is easier to recycle.

The object is achieved by a hinged-lid box having the features of claim 1. Advantageous embodiments of the hinged-lid box are specified in the dependent claims.

The hinged-lid box according to the invention comprises:

a lower part having a bottom wall with a polygonal base, side walls which are inclined outwardly and are connected to the lateral edges of the bottom wall via lower fold lines, corner joints between adjacent side walls in the form of two respective triangular tabs, which triangular tabs are connected to one another and of which each is connected to a lateral edge of one of the two adjacent side walls via an outer fold line, wherein the triangular tabs and the central fold line are folded against one another and against one of the two adjacent side walls and are adhesively bonded to the latter, dust flaps which are connected by upwardly bent upper fold lines to upwardly bent upper edges of side walls, and at least one side wall, the upper edge of which is a free edge and which is arranged between two adjacent side walls, the upper edges of which are connected with dust flaps, a hinged lid having a top wall with a polygonal base, which is connected at a lateral edge to the upper edge of a side wall via an upper fold line, and at least one insertion tab, which is connected to a lateral edge of the top wall via a lateral fold line, whereby when the dust flaps are folded into the opening between the upper edges of the side walls, the hinged lid can be folded over the opening and can be inserted with the at least one insertion tab between the side wall with the free edge and the dust flaps of the two adjacent side walls.

To close the folding box, the dust flaps are first folded into the opening between the upper edges of the side walls. The bent upper edges of the side walls guide the hinged lid when the opening is closed, so that it can be better inserted with the insertion tab into the gaps between the two dust flaps of the adjacent side walls and the side wall arranged in between. This makes it easier to close the hinged-lid box by hand and thus to pack the product for delivery to the customer. The folding box can be securely closed by inserting the insertion tab between the dust flaps and the side wall arranged therebetween, without the need for gluing or any other security measure. In addition, small pieces of product can be held back by the dust flaps folded into the opening until the hinged lid is closed. This also simplifies the packaging process. Compared to well-known clamshell folding boxes, the folding box makes better use of space, since it can be filled up to the upper edge and the hinged lid can be folded onto the filled product. Another advantage is that due to the bending of the upper edges of the side walls, the hinged lid is bent upwards in the center, so that more product can be accommodated there than in the edge regions, which is also advantageous for filling and closing the folding box and for space utilization. In addition to the upwardly bent hinged lid, the closed folding box has a slight inward bending on the side walls with the dust flaps, due to the bent fold lines, so that condensation can run off better from the hinged-lid boxes, which are stacked or stored close to each other, or can be transported away by passing air. Before use, a plurality of hinged-lid boxes can be stacked (nested) into one another to save space for transport and storage.

The number of corners of the bases of the bottom wall and top wall is preferably identical in order to completely cover the opening between the upper edges of the side walls. Because the side walls slope outwardly, it is preferred that the base of the top wall is larger than the base of the bottom wall to completely cover the opening.

If the bases have four corners, the carton is said to be square, if the bases have six corners, it is defined as hexagonal, etc.

According to an embodiment of the invention, the side wall opposite the side wall, the upper edge of which is connected to the hinged lid, has an upper edge designed as a free edge and the top wall has an insertion tab on the lateral edge which, when the hinged lid is closed, is adjacent to the upper edge of this side wall. In this way, in particular, a square folding box can be formed.

According to another embodiment, the side wall opposite the side wall, to which the hinged lid is hinged, has an upwardly bent upper edge which is connected to a dust flap by an upwardly bent upper fold line, the two side walls adjacent to this side wall each have an upper edge designed as a free edge and the cover wall is connected to insertion tabs at the lateral edges, which adjoin the upper edges of these two side walls when the hinged lid is closed. According to another embodiment, the two side walls adjacent to the side wall connected at the upper edge to the hinged lid, have upwardly bent upper edges connected to dust flaps by upwardly bent fold lines As a result, the hinged lid can be locked in the closed position by means of two insertion tabs. The gaps into which the two insertion tabs are inserted are arranged on both sides next to the side wall that is opposite the side wall to which the hinged lid is hinged. In this way it can be achieved that the hinged lid closes particularly tightly. A hexagonal folding box, for example, can be formed in this way.

According to another embodiment, the upper edges of the side walls that are not connected to a dust flap by an upper fold line are straight. In particular, the upper fold line, via which the hinged lid is connected to a side wall, is straight, which makes it easier to fold the hinged lid. Furthermore, the edges of the side walls, designed as free edges, on which the insertion tabs can be anchored, are straight, which makes it easier to close the hinged lid.

According to a further embodiment, the lateral edges of the top wall, which adjoin rectilinear upper edges of side walls when the hinged lid is closed, are also straight. Furthermore, the lateral edges of the top wall, which adjoin bent upper edges of side walls when the hinged lid is closed, are as convexly bent as the side walls after the dust flaps have been folded into the opening.

According to a further embodiment, the folded triangular tabs are each folded against the outside of a side wall and glued to it. This provides an interior space with smooth side walls, which makes it easier to remove product. Furthermore, the positioning and gluing of the triangular tabs to the outer sides of the side walls is advantageous for automatic erecting and gluing of the folded box.

According to a further embodiment, two arrangements of folded together triangular tabs are folded against the same side wall. This is also advantageous for the automatic erecting and gluing of the folding box.

According to another embodiment, two arrangements of folded together triangular tabs are each folded against side walls that are not connected to a dust flap by a bent fold line at the bent upper edge. Because the side walls do not have a bent edge with a dust flap hinged thereto, they do not bend when erected, but remain flat, making it easier to apply and glue the triangular tabs. According to a further embodiment, the triangular tabs are folded against side walls which are connected to the hinged lid at the upper edge via an upper fold line and which have an upper edge designed as a free edge. These side walls are additionally stabilized by the counter-folded and fixedly glued triangular tabs. This is advantageous for closing and holding the hinged lid in the closed position.

According to a further embodiment, the folding box is formed from a one-piece blank of foldable flat material. This is advantageous for production with the lowest possible use of material.

The invention is explained in more detail below with reference to the accompanying drawing of an exemplary embodiment. In the drawing.

The terms "below", "above" and terms derived therefrom such as "beneath" and "atop" refer to the erected folding box, wherein the bottom wall is aligned horizontally and the side walls extend upwards from the bottom wall.

Figure 1:
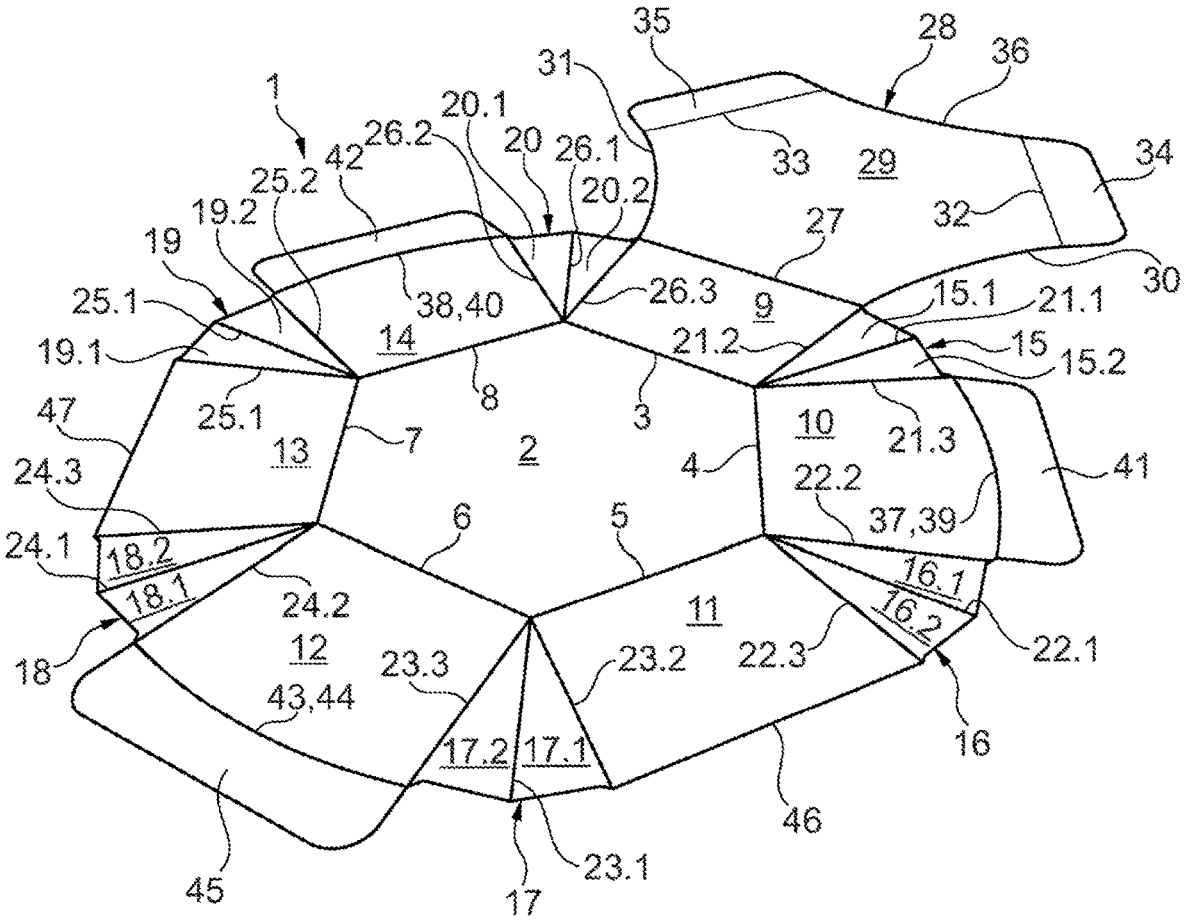
FIG. 1 shows a blank for manufacturing the folding box lying flat in a perspective view obliquely from above and from the side.

According to FIG. 1, the blank 1 has a bottom wall 2 with a hexagonal base region, wherein a side wall 9, 10, 11, 12, 13, 14 is articulated at each lateral edge of the bottom wall 2 via a straight lower fold line 3, 4, 5, 6, 7, 8. The side walls 9, 10, 11, 12, 13, 14 are each trapezoidal, wherein their width increases slightly from bottom upwards.

The lateral edges of adjacent side walls 9, 10, 11, 12, 13, 14 are connected to one another via corner joints 15, 16, 17, 18, 19, 20. Each corner joint 15 to 20 consists of two triangular tabs 15.1, 15.2 to 20.1, 20.2, which are connected to one another via central fold lines 21.1 to 26.1 and at which each one is connected to a lateral edge of one of the two adjacent side walls 9 to 14 via an outer fold line 21.2, 21.3 to 26.2, 26.3.

The side wall 9 is connected via a straight upper fold line 27 to a hinged lid 28 which has a top wall 29, which also has a hexagonal base. In addition to the lateral edge, which is connected to the side wall 9 via the upper fold line 27, the top wall 29 has two concave lateral edges 30, 31, each of which extends to a corner of the base region. Adjacent thereto, the top wall 29 has two straight lateral edges on both sides, which extend to the next corner. An insertion tab 34, 35 is hinged to each of these lateral edges via a lateral fold line 32, 33. The two outer corners of each insertion tab 34, 35 have roundings.

Opposite the lateral edge with which the top wall 29 is hinged to the side wall 9 via the upper fold line 27, the top wall 29 has a concavely bent lateral edge 36 which extends between the two straight lateral edges with the insertion tabs 34, 35.

On both sides next to the side wall 9, which is connected to the hinged lid via the upper fold line 27, the two adjoining side walls 10, 14 have a convexly bent upper edge 37, 38, on which a dust flap is hinged via a convexly bent upper fold line 39, 40 41, 42.

The side wall 12, which is arranged opposite the side wall 9, which is connected to the hinged lid 28 via an upper fold line 27, is also connected at the upper edge 43 via a convexly bent upper fold line 44 to a dust flap 45.

The two outer corners of each dust flap 41, 42, 45 are also rounded.

The side walls 11, 13, which are arranged between the side walls 10 and 12, 14, which are connected to dust flaps 41, 42, 45 via bent fold lines 39, 40, 44, each have an upper edge in the form of a straight free edge 46, 47.

Figure 2:
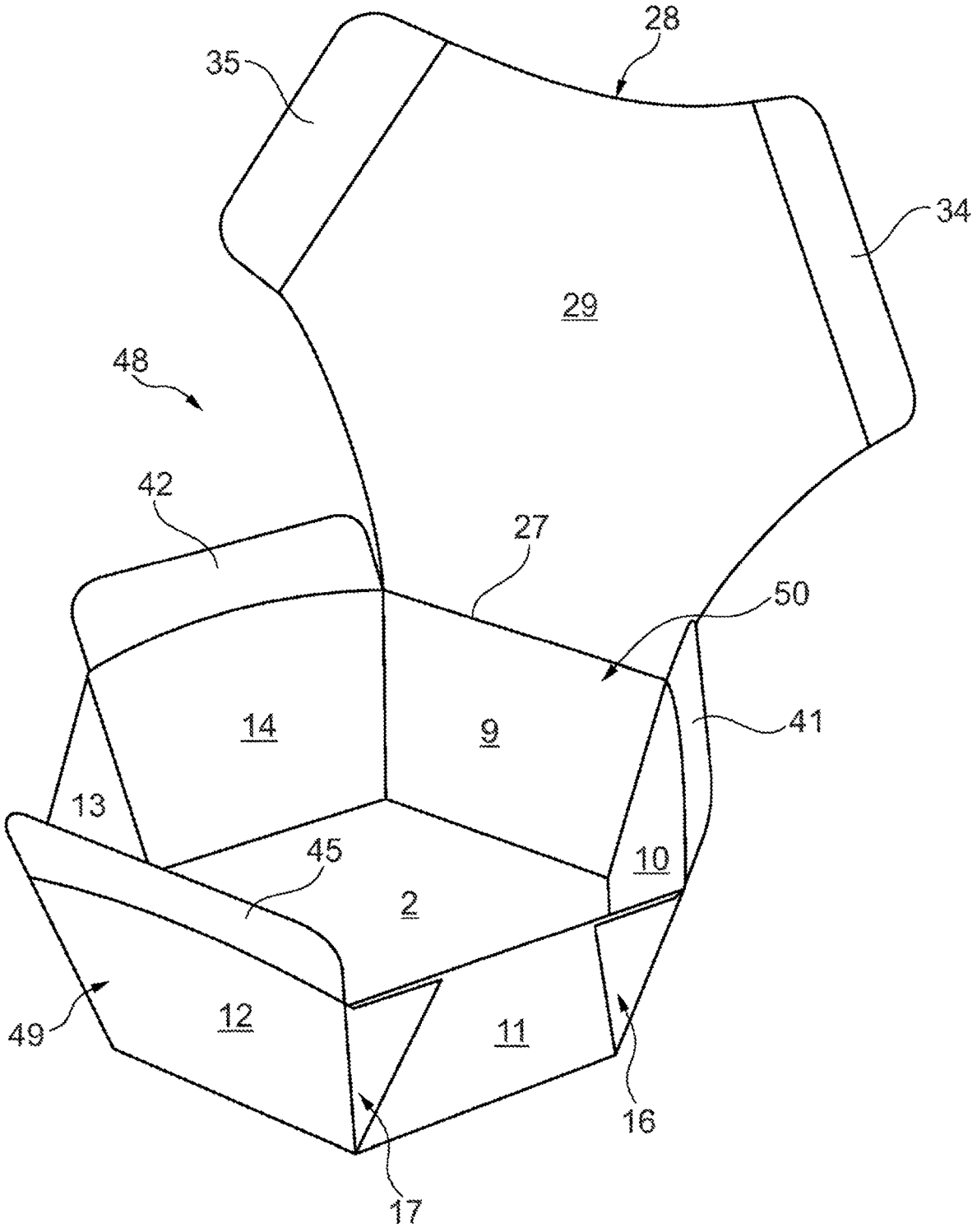
FIG. 2 shows a folding box formed from the blank with the hinged lid open, in a perspective view obliquely from above and from the side.

According to FIG. 2, the folding box 48 is erected by folding the triangular tabs 15.1, 15.2 to 20.1, 20.2 of each corner joint 15 to 20 around the central fold lines 21.1 to 26.1 and by gluing them against each other and against the outer side of a side wall 9, 11, 13, the upper edge of which is straight. As a result, a cup or shell-shaped lower part 49 is formed. The upper edges of the side walls 9 to 14 delimit an opening 50 for filling and emptying the lower part of the folding box 48. In this state, a large number of identically designed folding boxes 48 can be nested in one another.

A single folding box 48 can be removed from the stack for filling. After loading salad or other small-sized product, the three dust flaps 41, 42, 45 are folded over the opening 50 between the upper edges of the side walls 9 to 14, in an approximately horizontal orientation. As a result, the filled product is held back, even if it is filled up to the upper edge of the lower part 49. When the dust flaps 41, 42, 45 are folded over, the side walls 10, 12, 14 connected thereto via upper fold lines 39, 40, 44 are bent somewhat inwards.

Figure 3:
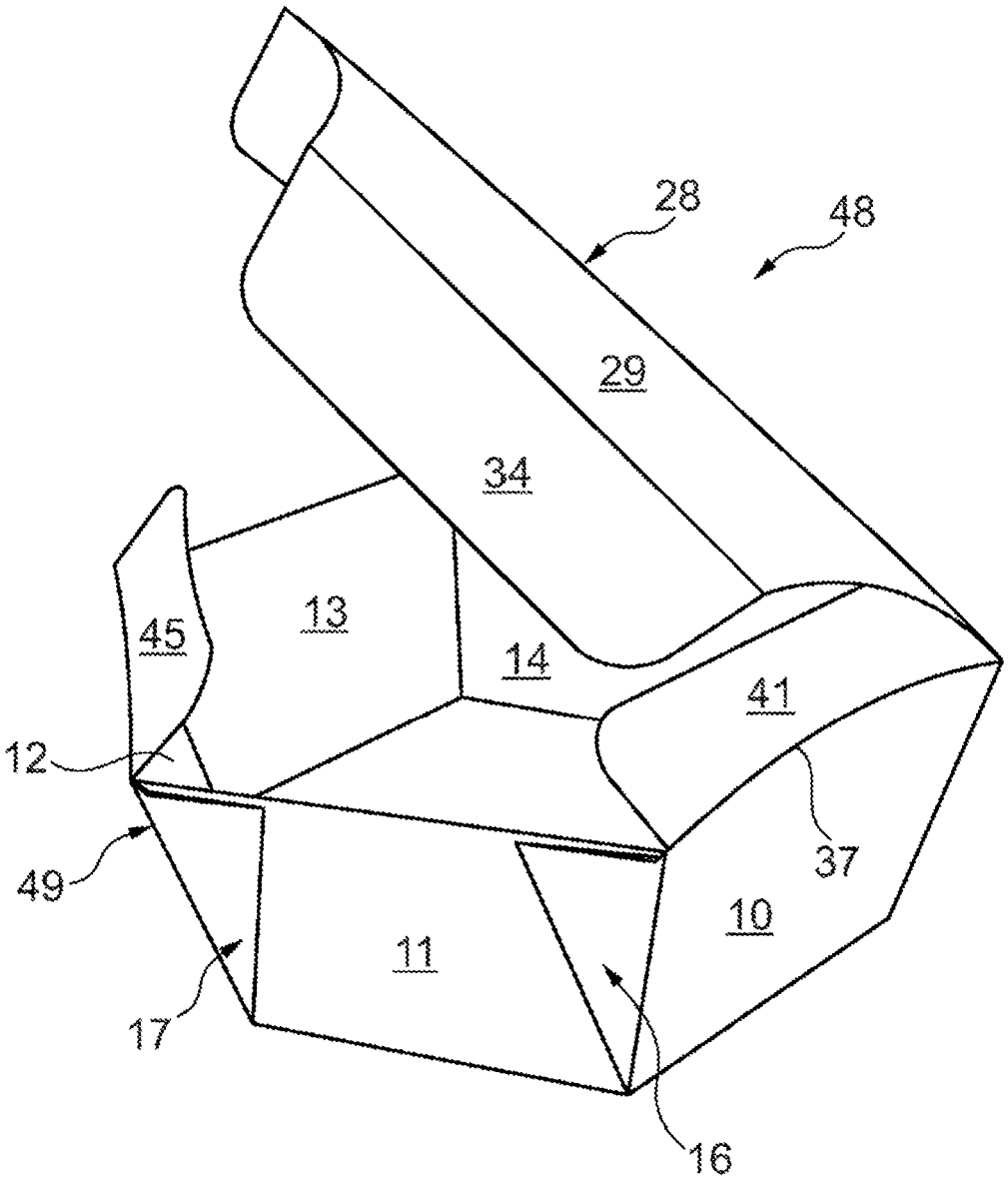
FIG. 3 shows the folding box at the beginning of the closing of the hinged lid in a perspective view from the side.
Figure 4:
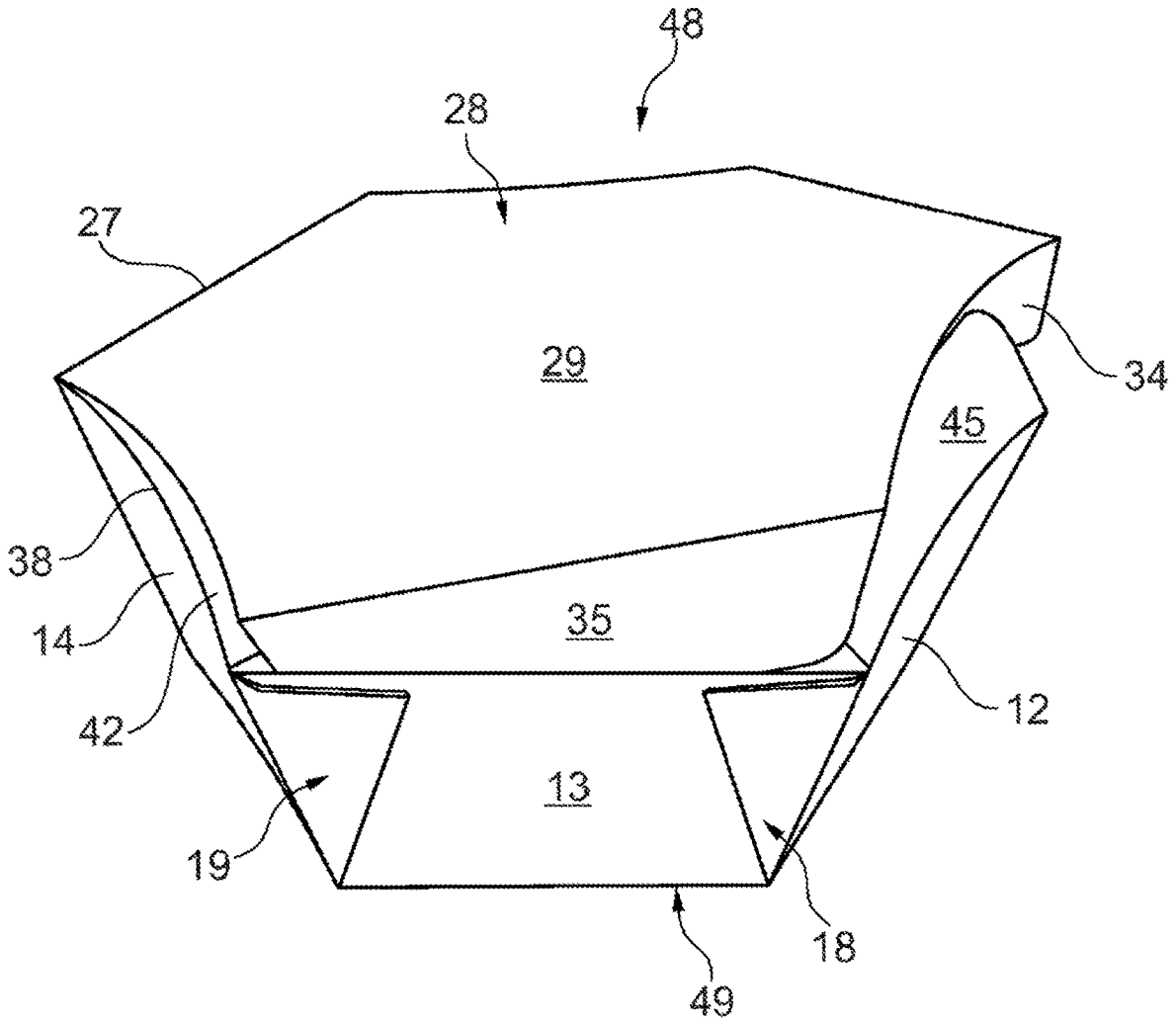
FIG. 4 shows the folding box shortly before the hinged lid is completely closed, in a perspective view from the opposite side.
Figure 5:
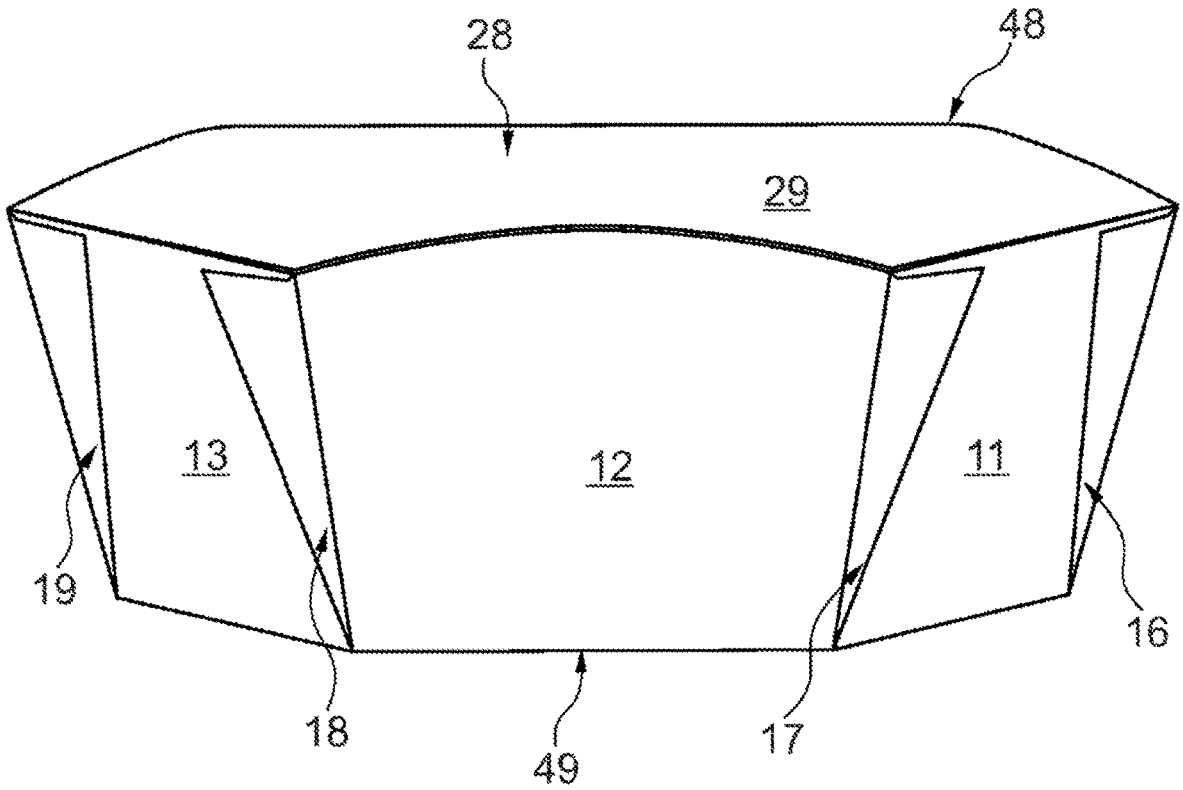
FIG. 5 shows the closed folding box in front view.
Figure 6:
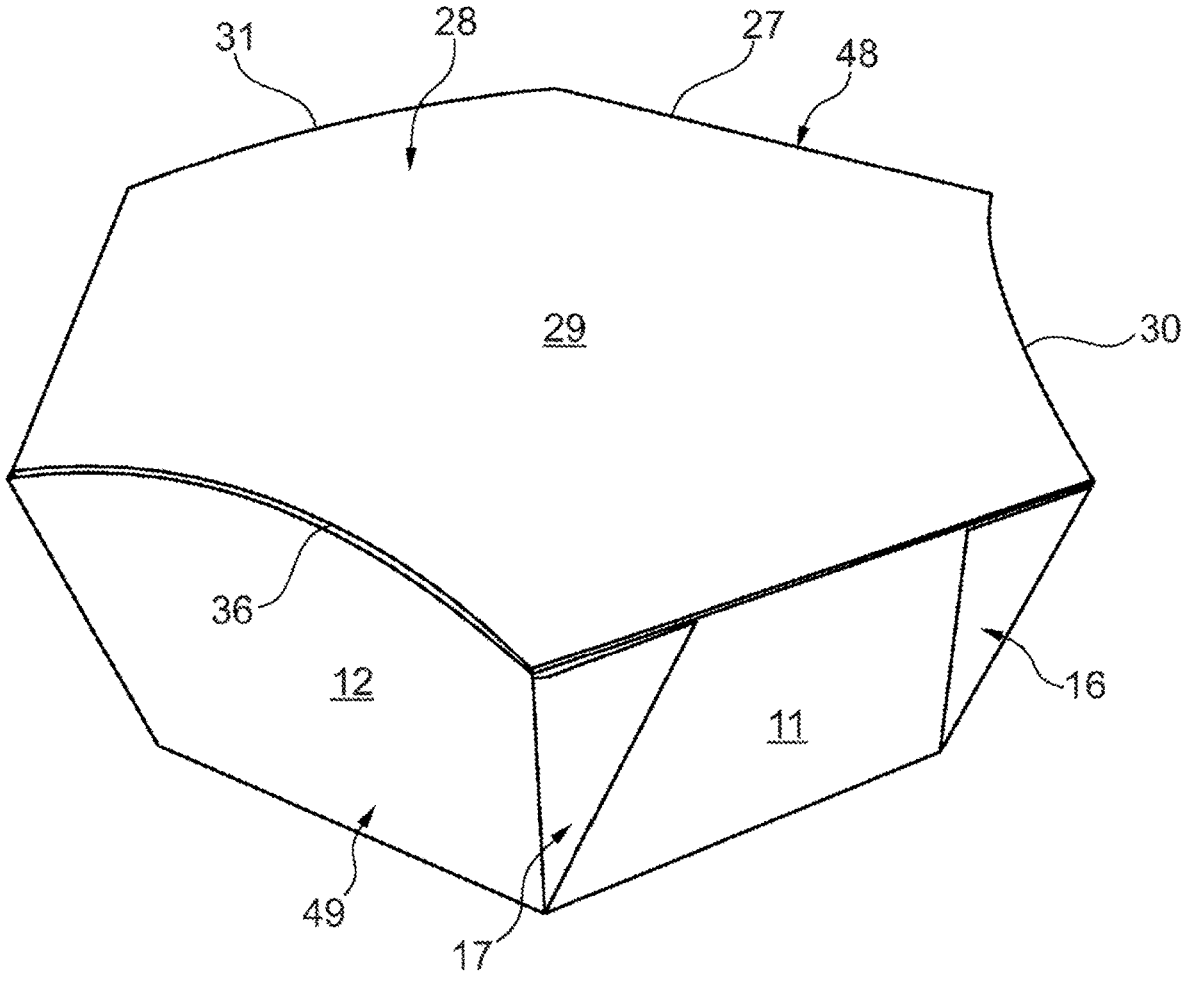
FIG. 6 shows the closed folding box in a perspective view obliquely from above and from the side.
Figure 7:
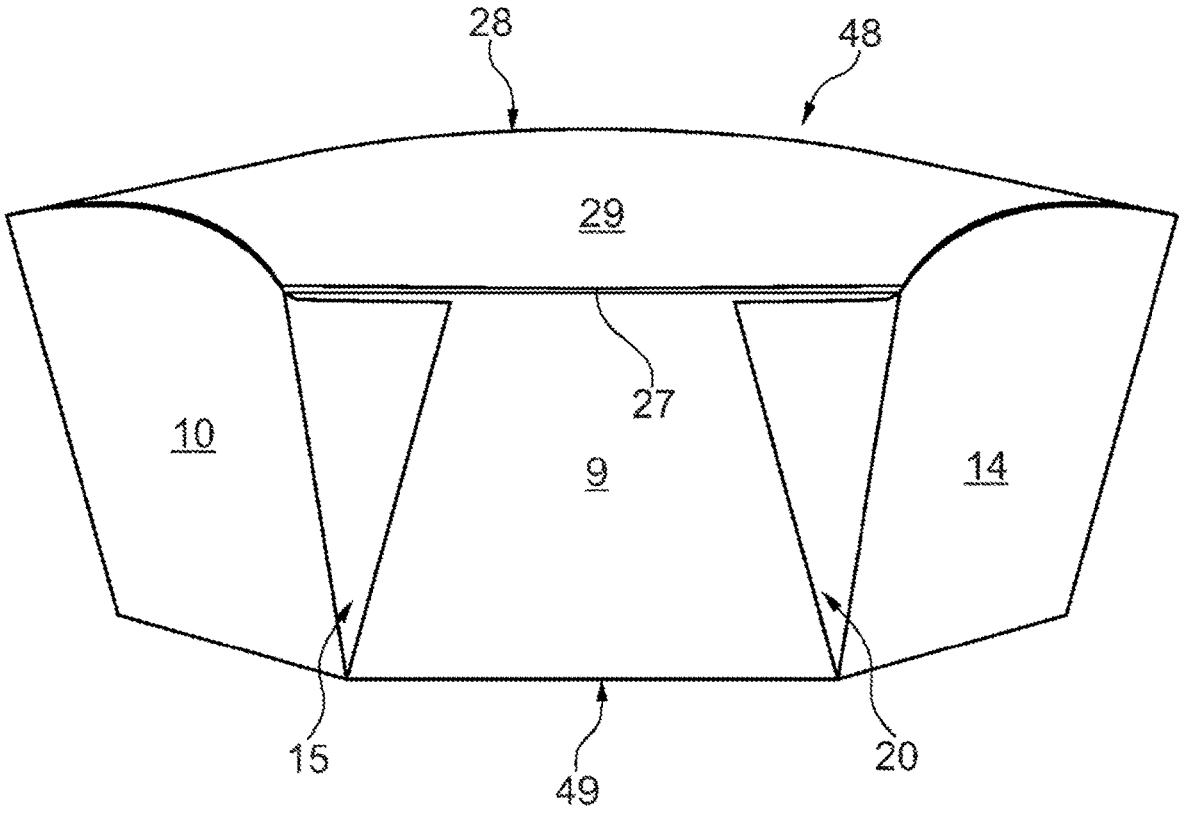
FIG. 7 shows the closed folding box in a rear view.
Figure 8:
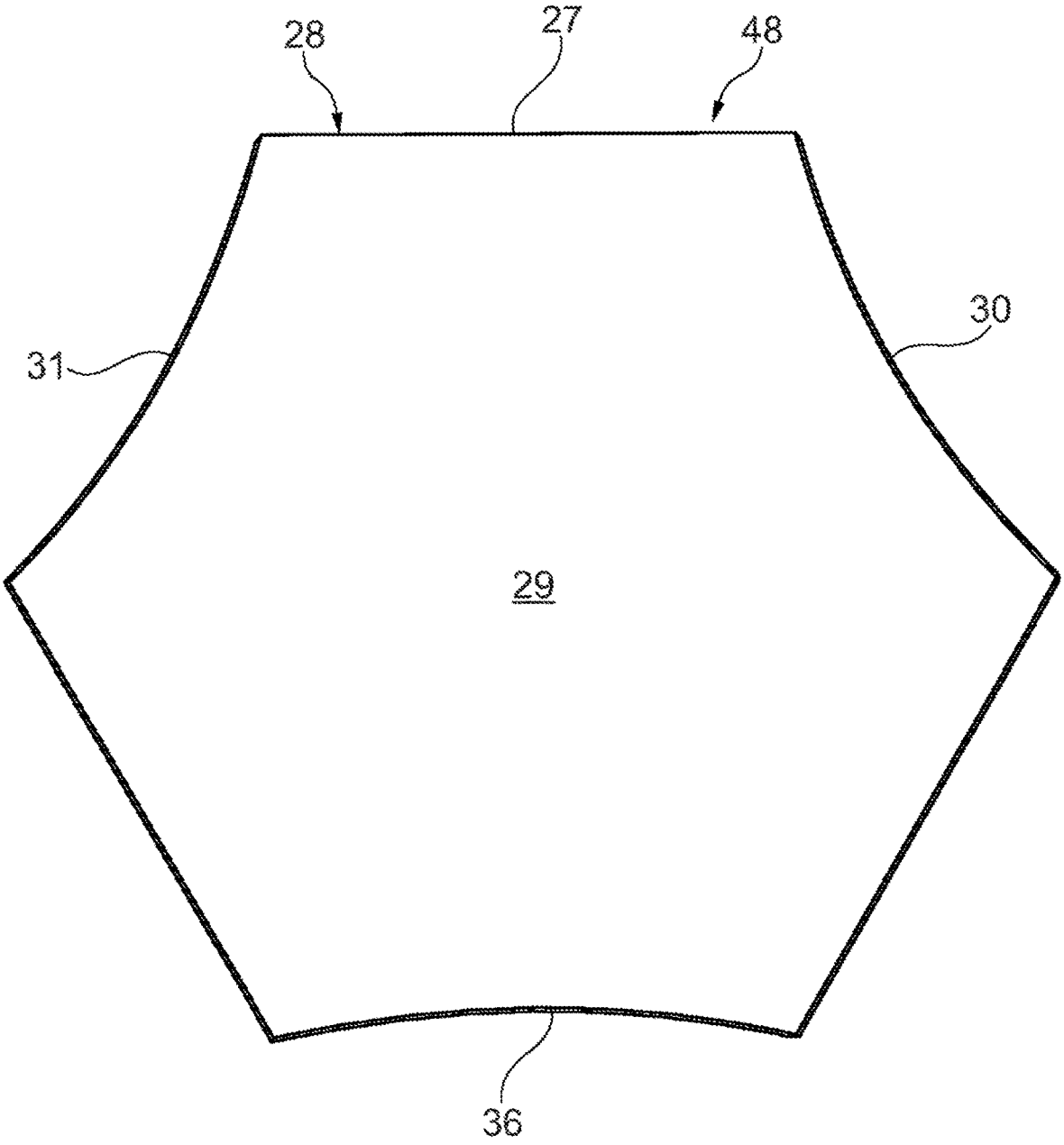
FIG. 8 shows the closed folding box in a plan view.

The folding box 48 is then closed by closing the hinged lid 28. Hereby, according to FIGS. 3 and 4, the top wall 29 is guided laterally on the bent upper edges 37, 38 of the side walls 10, 14, which are arranged on both sides of the side wall 9 to which the hinged lid 28 is hinged. As a result, the insertion tabs 34, 35 are aligned with the gaps between the dust flaps 41, 45 and 42, 45 and the side walls 11, 13 arranged therebetween and can be easily inserted into them.

According to FIGS. 5 to 8, the hinged lid 28 of the closed folding box 48 is slightly bulging upwards in the middle region, so that more product can be accommodated there.

The top wall 29 is covered below by the dust flaps 41, 42, 45 at the remaining edges. The concavely bent lateral edges 30, 31, 36 of the top wall 29 are adapted to the bent upper edges of the adjacent side walls 10, 12, 14. This achieves a tightly and securely closing hinged-lid box.

LIST OF REFERENCE NUMERALS

1 blank
2 bottom wall
3, 4, 5, 6, 7, 8 lower fold line
9, 10, 11, 12, 13, 14 side wall
15, 16, 17, 18, 19, 20 corner joint
15.1, 15.2 to 20.1, 20.2 triangular tab
21.1 to 26.1 central fold line
21.2, 21.3 to 26.2, 26.3 outer fold line
27 upper fold line
28 hinged lid
29 top wall
30, 31 concave lateral edge
32, 33 lateral fold line
34, 35 insertion tab
36 concave lateral edge
37, 38 upper edge
39, 40 convex upper fold line
41, 42 dust flap
43 upper edge
44 convex upper fold line
45 dust flap
46, 47 free edge
48 folding box
49 lower part
50 opening

The invention claimed is:

1. A folding box comprising:

a lower part having:

a bottom wall, a plurality of side walls inclined outwardly and connected to the bottom wall by respective lower fold lines, the plurality of side walls forming an opening of the lower part, corner joints disposed between adjacent side walls of the plurality of side walls, the corner joints each comprising two respective triangular tabs that are connected to one another at a respective central fold line, each respective triangular tab connected to a respective lateral edge of one of the adjacent side walls by an outer fold line, wherein the two respective triangular tabs are folded at the central fold line against one another and against one of the adjacent side walls and are adhesively bonded to the one of the adjacent side walls, a plurality of dust flaps, each connected to a respective one of the plurality of side walls by a respective upper fold line, and wherein at least one of the plurality of side walls has an upper edge comprising a free edge, the at least one of the plurality of side walls is arranged between two adjacent side walls each connected to a respective dust flap, and a hinged lid having a top wall connected to an upper edge of one of the plurality of side walls by an upper fold line, the top wall including at least one lateral edge, and at least one insertion tab connected to the top wall by a lateral fold line, wherein the plurality of dust flaps are arranged to be folded towards the opening of the lower part, wherein the hinged lid is arranged to be folded over the opening in a closed position, wherein in the closed position the at least one insertion tab is inserted in a gap disposed between the at least one of the plurality of side walls with the free edge and the dust flaps of the two adjacent side walls and wherein in the closed position the at least one lateral edge is convexly bent and is adjacent the upper edge.

2. The folding box of claim 1, wherein a number of corners of the bottom wall and the top wall are equal.

3. The folding box of claim 1 wherein the top wall is larger than the bottom wall.

4. The folding box of claim 1, wherein the plurality of side walls comprises a side wall opposite the respective one of the plurality of side walls connected to the top wall that is connected to the respective dust flap by an upwardly bent upper fold line, the two side walls adjacent to the side wall opposite the one of the plurality of side walls connected to the top wall each have an upper edge comprising a free edge and the at least one insertion tab comprises two insertion tabs and the lateral fold line comprises two lateral fold lines, a respective one of the two lateral fold lines is adjacent a respective upper edge the two side walls adjacent to the side wall opposite the one of the plurality of side walls connected to the top wall when the hinged lid is closed.

5. The folding box of claim 1, wherein the plurality of side walls comprise two side walls adjacent to the one of the plurality of side walls connected to the top wall, which are connected to the respective dust flap by upwardly bent fold lines.

6. The folding box of claim 1, wherein the upper edge of the at least one of the plurality of side walls is straight.

7. The folding box of claim 1, wherein the two respective triangular tabs are adhesively bonded to the one of the adjacent side walls with glue.

8. The folding box of claim 1, wherein the corner joints comprise a first corner joint comprising a first pair of the two respective triangular tabs and a second corner joint comprising a second pair of the two respective triangular tabs, the first pair of the two respective triangular tabs and the second pair of the two respective triangular tabs are folded against the one of the adjacent side walls.

9. The folding box of claim 8, wherein the first pair of the two respective triangular tabs and the second pair of the two respective triangular tabs are folded against the one of the plurality of side walls which is connected to the top wall at the upper fold line.

10. The folding box of claim 9, wherein the corner joints further comprise a third corner joint comprising a third pair of the two respective triangular tabs and a fourth corner joint comprising a fourth pair of the two respective triangular tabs, the third pair of the two respective triangular tabs and the second pair of the two respective triangular tabs are folded against the at least one of the plurality of side walls having the free edge.

11. A folding box comprising a lower part and a hinged lid positionable relative to the lower part to a closed position of the folding box, the lower part comprising a bottom wall, a plurality of side walls foldably connected to the bottom wall and positionable relative to the bottom wall to form an interior space of the folding box, a plurality of dust flaps each foldably connected to a respective one of the plurality of side walls, the plurality of side walls forming an opening of the interior space at respective upper edges of the plurality of side walls, wherein at least one of the plurality of side walls has an upper edge comprising a free edge, the at least one of the plurality of side walls arranged between two adjacent side walls each foldably connected to a respective one of a plurality of dust flaps, and wherein the hinged lid comprises a top wall foldably connected to of one of the plurality of side walls the hinged lid including at least one insertion tab foldably connected to the top wall and further including a plurality of lateral edges, wherein in the closed position the at least one insertion tab is inserted into a gap disposed adjacent one of the plurality of side walls with the free edge and between two of the plurality of dust flaps and wherein in the closed position at least one of the plurality of lateral edges of the top wall is curved and is adjacent at the least one of the plurality of side walls.

12. The folding box of claim 11, wherein the plurality of side walls are inclined outwardly relative to the bottom wall.

13. The folding box of claim 11, wherein the lower part further comprises corner joints between adjacent side walls of the plurality of side walls, the corner joints comprise two respective triangular tabs.

14. The folding box of claim 13, wherein the two respective triangular tabs are foldably to one another at a respective central fold line and each of two respective triangular tabs are connected to a lateral edge of one of the adjacent side walls by an outer fold line.

15. The folding box of claim 13, wherein the two respective triangular tabs are folded around the respective central fold line against one another and against one of the adjacent side walls.

16. The folding box of claim 15, wherein the at least one insertion tab comprises two insertion tabs and each insertion tab is foldably connected to the top wall at a respective lateral fold line, each respective lateral fold line is adjacent a respective upper edge of the two side walls adjacent to the side wall opposite the one of the plurality of side walls connected to the top wall when the hinged lid is in the closed position.

17. The folding box of claim 16, wherein the upper edge of the at least one of the plurality of side walls is straight.

18. The folding box of claim 13, wherein the two respective triangular tabs are adhesively bonded to the one of the adjacent side walls.

19. The fold box of claim 13, wherein the corner joints comprise a first corner joint comprising a first pair of the two respective triangular tabs and a second corner joint comprising a second pair of two respective triangular tabs, the first pair of two respective triangular tabs and the second pair of two respective triangular tabs are folded against one of the plurality of side walls.

20. The folding box of claim 11, wherein the plurality of side walls comprises a side wall opposite the one of the plurality of side walls connected to the top wall having an upper edge which is connected to the dust flap by, the two side walls adjacent to the side wall opposite the one of the plurality of side walls connected to the top wall each have an upper edge comprising a free edge.

21. The folding box of claim 20, wherein the upper edges of the two side wall adjacent to the one of the plurality of side walls connected to the top wall are curved.

22. The folding box of claim 11, wherein the plurality of side walls comprises two side walls adjacent to the one of the plurality of side walls connected to the top wall having upper edges foldably connected to the respective dust flap.

23. The folding box of claim 19, wherein the first pair of two respective triangular tabs and the second pair of two respective triangular tabs are folded against the one of the plurality of side walls which is foldably connected to the top wall.

24. The folding box of claim 11, wherein the corner joints further comprise a third corner joint comprising a third pair of two respective triangular tabs and a fourth corner joint comprising a fourth pair of two respective triangular tabs, the third pair of two respective triangular tabs and the second pair of the two respective triangular tabs are folded against the at least one of the plurality of side walls having the free edge.

* * * * *